US006545572B1

(12) United States Patent
Ohta et al.

(10) Patent No.: US 6,545,572 B1
(45) Date of Patent: Apr. 8, 2003

(54) MULTI-LAYER LINE INTERFACIAL CONNECTOR USING SHIELDED PATCH ELEMENTS

(75) Inventors: Masahiko Ohta, Oyama (JP); Mitsuru Hirao, Shimodate (JP); Hisayoshi Mizugaki, Ibaraki-ken (JP); Takao Michisaka, Shimodate (JP); Kiichi Kanamaru, Ibaraki-ken (JP)

(73) Assignee: Hitachi Chemical Co., Ltd., Tokyo (JP)

( * ) Notice: Subject to any disclaimer, the term of this patent is extended or adjusted under 35 U.S.C. 154(b) by 103 days.

(21) Appl. No.: 09/657,102

(22) Filed: Sep. 7, 2000

(51) Int. Cl.[7] ..... H01P 5/02
(52) U.S. Cl. ..... 333/246
(58) Field of Search ..... 333/26, 246

(56) References Cited

U.S. PATENT DOCUMENTS 5,093,639 A * 3/1992 Franchi et al. ..... 333/246 X
5,471,181 A * 11/1995 Park ..... 333/246
6,023,210 A * 2/2000 Tulintseff ..... 333/246 X

FOREIGN PATENT DOCUMENTS

JP 11261308 9/1999

OTHER PUBLICATIONS

An English Language abstract of JP 11–261308, Sep. 24, 1999.

"Electromagnetic Coupling Between Two–Layers Microstriplines" (issued by the Institute of Electronics, Information and Communication Engineers in Japan on Sep. 15, 1990), along with English Language abstract.

* cited by examiner

*Primary Examiner*—Benny Lee
(74) *Attorney, Agent, or Firm*—Greenblum & Bernstein, P.L.C.

(57) ABSTRACT

This triplate line interfacial connector electrically connects a first triplate line comprised of a first grounding conductor, first dielectric, first power feeding substrate, second dielectric and second grounding conductor, and a second triplate line comprised of a second grounding conductor, third dielectric, second power feeding substrate, fourth dielectric, and third grounding conductor. A patch pattern is formed at a connecting terminal portion of each power feeding line. Two shield spacers each having a through portion around the patch pattern are provided. A first slot is formed at a connecting position between the two triplate lines in the second grounding conductor.

3 Claims, 7 Drawing Sheets

MULTI-LAYER LINE INTERFACIAL CONNECTOR USING SHIELDED PATCH ELEMENTS

BACKGROUND OF THE INVENTION

1. Field of the Invention

The present invention relates to an interfacial connecting structure for triplate line in the band of millimeter wave.

2. Description of the Related Art

A conventional triplate line interfacial connecting structure is constructed as shown in FIG. 1 and FIG. 2, as follows. Namely, a first power feeding substrate 6 on which a first power feeding line 5 is formed and which is sandwiched by a first dielectric 4*a* and a second dielectric 4*b,* is disposed substantially in the middle of a first grounding conductor 1 and a second grounding conductor 2 to form a first triplate line. Further, a second power feeding substrate 9 on which a second power feeding line 8 is formed and which is sandwiched by a third dielectric 7*a* and a fourth dielectric 7*b,* is disposed substantially in the middle of the second grounding conductor 2 and a third grounding conductor 3 to form a second triplate line. Then, the first triplate line and the second triplate line are electromagnetically coupled with each other through a second slot 14 formed in the second grounding conductor 2.

A low dielectric constant material having a relative dielectric constant $\epsilon_1 \approx 1$ is used for the first dielectric 4*a,* second dielectric 4*b,* third dielectric 7*a* and fourth dielectric 7*b* in order to suppress a loss in the power feeding lines.

Further, a distance between the first grounding conductor 1 and the second grounding conductor 2 and a distance between the second grounding conductor 2 and the third grounding conductor 3 are set to less than substantially ⅕ of a line effective wave length (line effective wave length=free space wave length/square root of relative dielectric constant of a dielectric) of a frequency for use in order to avoid an occurrence of high order mode in a line under the frequency for use.

To couple the first power feeding line 5 with the second power feeding line 8 electromagnetically through the second slot 14 in a preferable condition, the second slot 14 has to be resonant at the frequency for use. Thus, as shown in FIG. 2, a resonator length L8 of the second slot 14 is set substantially ½ of the line effective wave length of the frequency for use and then, the second slot 14 has to be disposed at a position corresponding to line length L7 which is substantially ¼ of the line effective wave length of the frequency for use from the connecting terminal end of each of the first power feeding line 5 and the second power feeding line 8.

Generally, a width of the second slot 14 is substantially 1/10 of the line effective wave length of the frequency for use.

By setting the resonator length L8 of the second slot 14 substantially ½ of the line effective wave length of the frequency for use, the second slot resonates at the frequency for use. Further, by setting the setting position L7 of the second slot 14 from the connecting terminal portion of each of the first power feeding line 5 and the second power feeding line 8 substantially ¼ of the line effective wave length of the frequency for use, matching of the impedance estimated from the power feeding line to the second slot 14 is secured so that electricity is transmitted without reflection.

However, in the conventional triplate line interfacial connecting structure shown in FIG. 1, variations of the frequency relative to an error in the length of the resonator length L8 of the first power feeding line 5 is large and variations of impedance estimated from the power feeding line to the second slot 14 relative to an error in the setting position L7 of the second slot 14 from the connecting terminal portion of each of the first power feeding line 5 and the second power feeding line 8 is large. Thus, there is such a problem that the frequency characteristic becomes a narrow band.

Together with electromagnetic coupling between the first power feeding line 5, second power feeding line 8 and second slot 14, parallel plate components transmitted in lateral direction between the first grounding conductor 1 and the second grounding conductor 8 and between the third grounding conductor 2 and the second grounding conductor 2 are generated so that loss increases.

Further, if it is intended to achieve the conventional structure in a very high frequency band, for example 76.5 GHz, the resonator length L8 of the second slot 14 shown in FIG. 2 is substantially 2 mm and the width is less 0.4 mm, which are very fine dimensions for processing. Therefore, the second slot 14 is difficult to form by mechanical press processing or the like. Further, the setting position L7 of the second slot 14 from the connecting terminal portion of each of the first power feeding line 5 and the second power feeding line 8 has to be set as highly accurately as up to about 1 mm. Therefore, there is such a problem that a highly accurate processing method and an assembly method have to be always selected thereby leading to increased production cost.

SUMMARY OF THE INVENTION

An object of the present invention intends is to provide a triplate line interfacial connector excellent in preventing a loss and easy to assemble.

To achieve the above object, according to an aspect of the present invention, there is provided a triplate line interfacial connector for electrically connecting a first triplate line formed by disposing a first power feeding substrate, which is sandwiched by a first dielectric and a second dielectric and on which a first power feeding line is formed, substantially in the middle of a first grounding conductor and a second grounding connector and a second triplate line formed by disposing a second power feeding substrate, which is sandwiched by a third dielectric and a fourth dielectric and on which a second power feeding line is formed, substantially in the middle of the second grounding conductor and a third grounding conductor, wherein a first patch pattern and a second patch pattern are formed at a connecting terminal portion of a power feeding line of the first power feeding substrate and a connecting terminal portion of a second power feeding line of the second power feeding substrate, respectively, the first and second dielectrics are removed from around the first patch pattern while a first shield spacer and a second shield spacer each having a through portion relatively larger than the size of the first patch pattern and the first power feeding line connected thereto are provided at the portions in which the first and second dielectrics are removed, the third and fourth dielectrics are removed from around the second patch pattern while a third shield spacer and a fourth shield spacer each having a through portion relatively larger than the size of the second patch pattern and the second power feeding line connected thereto are provided at the portions in which the third and fourth dielectrics are removed, and a first slot is formed at a potion of the second grounding conductor, the portion corresponding to the first patch pattern and the second patch pattern.

According to a preferred embodiment of the present invention, a length of each of the first patch pattern and the second patch pattern in a direction in which each thereof is connected to line is substantially 0.38 times a free space wave length of a frequency for use, a dimension of the through portion of each of the first shield spacer, second shield spacer, third shield spacer, and fourth shield spacer in a direction that the periphery of the patch is connected to the line is substantially 0.6 times the free space wave length of the frequency for use, and a dimension of the first slot in the direction of the line connection is substantially 0.6 times the free space wave length of the frequency for use.

Further, according to a preferred embodiment of the present invention, the shape of each of the first patch pattern and the second patch pattern is circular, a diameter thereof is substantially 0.38 times the free space wave length of the frequency for use, the shape of the through portion around the patch in each of the first shield spacer, second shield spacer, third shield spacer and fourth shield spacer is circular, a diameter of the through portion around the patch is substantially 0.6 times the free space wave length of the frequency for use, and the shape of the first slot is circular while the diameter thereof is substantially 0.6 times the free space wave length of the frequency for use.

The nature, principle and utility of the invention will become more apparent from the following detailed description when read in conjunction with the accompanying drawings.

DESCRIPTION OF THE PREFERRED EMBODIMENTS

Figure 1:
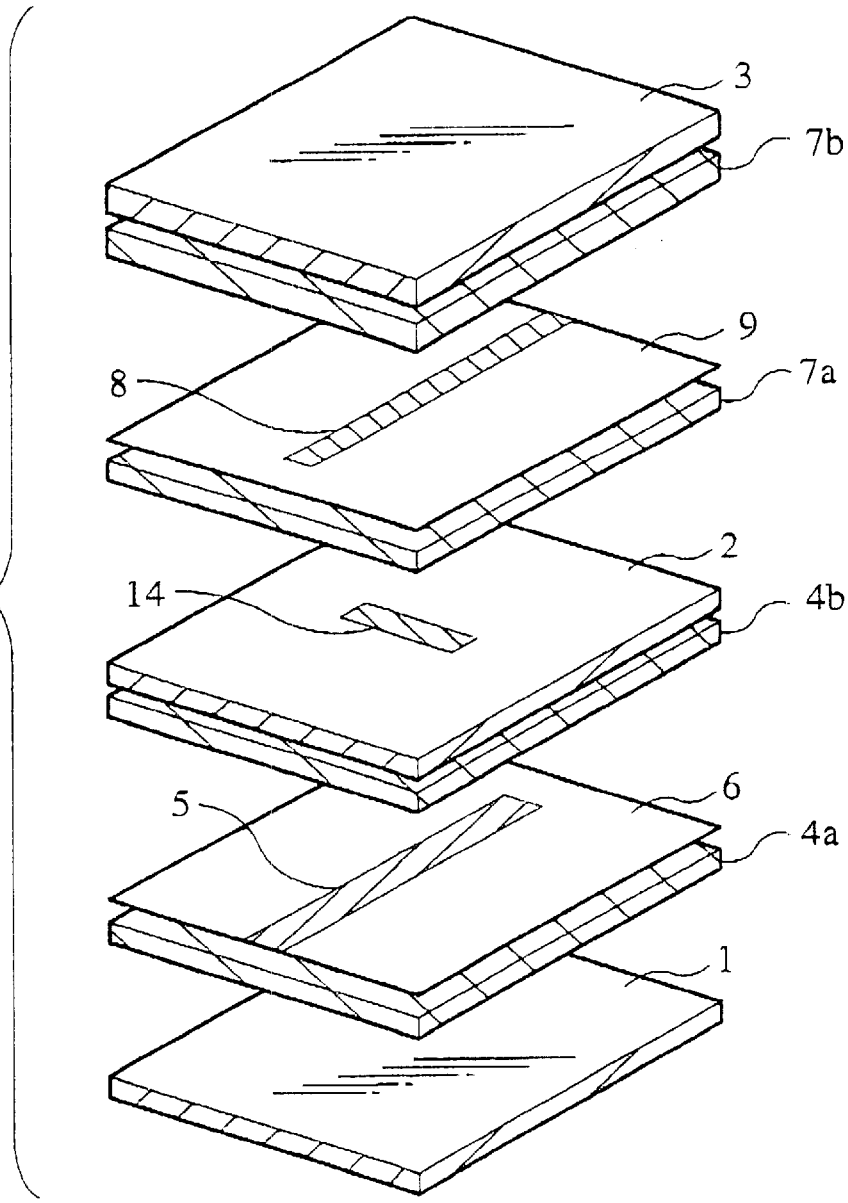
FIG.1 PRIOR ART
FIG. 1 is a disassembly perspective view showing a conventional example.
Figure 2:
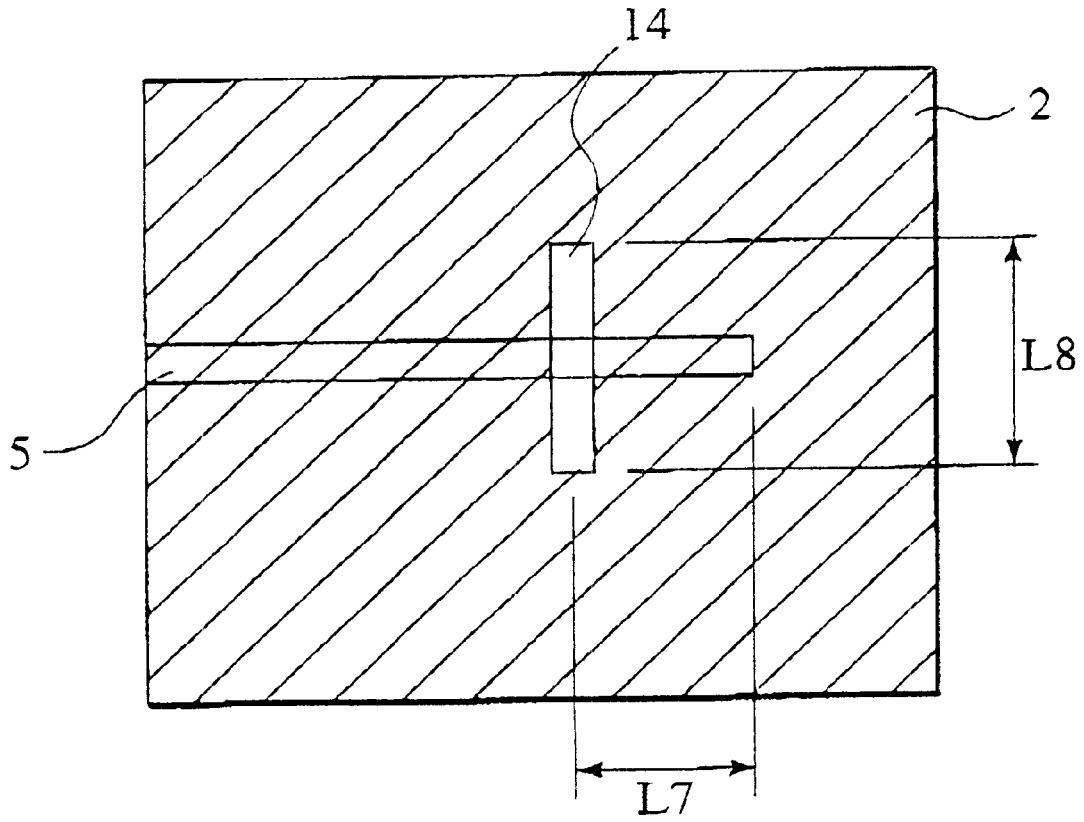
FIG.2 PRIOR ART
FIG. 2 is a plan view for explaining a problem of the conventional example.

Hereinafter, preferred embodiments of the present invention will be described in detail with reference to the accompanying drawings. Reference numerals in different drawing figures refer to the same features.

Figure 3:
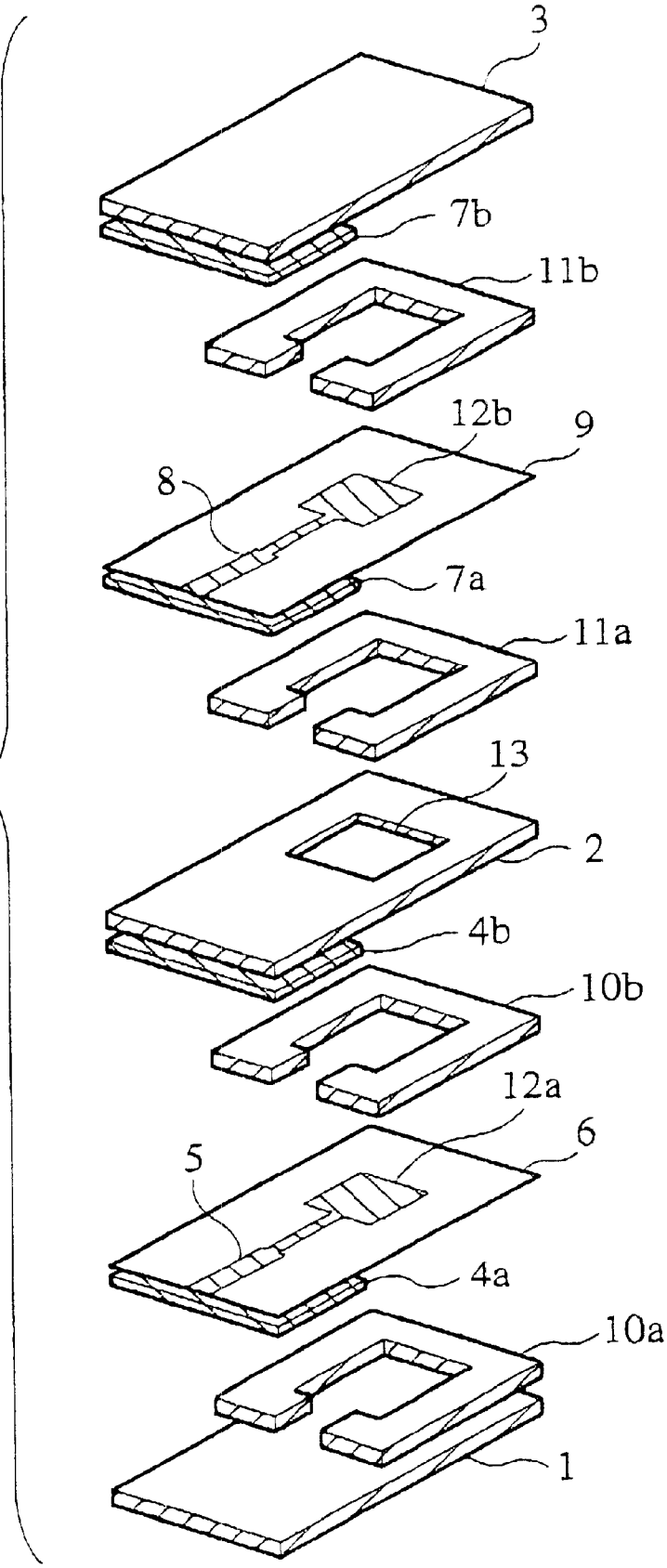
FIG. 3 is a disassembly perspective view showing an embodiment of the triplate line interfacial connector of the present invention.

FIG. 3 is a disassembly perspective view showing an embodiment of the triplate line interfacial connector of the present invention.

In the triplate line interfacial connector shown in FIG. 3, a first triplate line formed by disposing a first power feeding substrate 6, which is sandwiched by a first dielectric 4*a* and a second dielectric 4*b* and on which a first power feeding line 5 is formed, substantially in the middle of a first grounding conductor 1 and a second grounding conductor 2; and a second triplate line formed by disposing a second power feeding substrate 9, which is sandwiched by a third dielectric 7*a* and a fourth dielectric 7*b* and on which a second power feeding line 8 is formed, substantially in the middle of the second grounding conductor 2 and the third grounding conductor 3 are connected to each other electrically.

A first patch pattern 12*a* and a second patch pattern 12*b* are formed at a connection terminal portion of a first power feeding line 5 of the first power feeding substrate 6 and at a connection terminal portion of a second power feeding line 8 of the second power feeding substrate 9.

Then, a portion surrounding the first patch pattern 12*a* of each of a first dielectric 4*a* and a second dielectric 4*b* is cut out, and a first shield spacer 10*a* and a second shield spacer 10*b* each having a through portion relatively larger than the first patch pattern 12*a* and the first power feeding line 5 connected thereto are provided at each cut portion.

A portion surrounding the second patch pattern 12*b* of each of a third dielectric 7*a* and a fourth dielectric 7*b* is cut out, and a third shield spacer 11*a* and a fourth shield spacer 11*b* each having a through portion relatively larger than the second patch pattern 12*b* and the second power feeding line 8 connected thereto are provided at each cut portion.

A first slot 13 is formed in a portion of the second grounding conductor 2 located in the middle of the first patch pattern 12*a* and the second patch pattern 12*b*.

In the triplate line interfacial connector shown in FIG. 3, the first patch pattern 12*a* and the second patch pattern 12*b* are coupled with each other electromagnetically through the frequency for use so as to form a resonator. Then, the first patch pattern 12*a* and the second patch pattern 12*b* are capable of securing a characteristic of a very wide band as compared to the conventional resonator.

The first slot 13 functions as a window for electric power to be transmitted from the first power feeding line 5 to the second power feeding line 8 without disturbing electromagnetic coupling of the respective patches and does not resonate unlike the conventional slot. Thus, a deviation of the frequency in the first slot 13 is small with respect to an error in length of the resonator length L3 in a direction of the line connection of the same first slot 13. Thus, a triplate line interfacial connector stabilized in the frequency characteristic can be established by the wide band characteristic of the resonator due to the aforementioned patch pattern as well.

A first shield spacer 10*a,* second shield spacer 10*b,* third shield spacer 11*a* and fourth shield spacer 11*b* form metallic walls around the first patch pattern 12*a* and the second patch pattern 12*b* with a distance therefrom. Consequently, no parallel plate component is generated so that all the electric power from the first patch pattern 12*a* is transmitted to the second patch pattern 12*b* thereby achieving a low loss characteristic.

Further, the first shield spacer 10*a,* second shield spacer 10*b,* third shield spacer 11*a* and fourth shield spacer 11*b* function as spacers for maintaining the first power feeding substrate 6 and the second power feeding substrate 9 substantially in the middle of the first grounding conductor 1 and the second grounding conductor 2 and substantially in the middle of the second grounding 2 conductor and the third grounding conductor 3, respectively. Consequently, a distance between the first patch pattern 12*a* and the second patch pattern 12*b* can be maintained stable so as to always keep a stabilized electromagnetic coupling between the both patches.

Figure 4A:
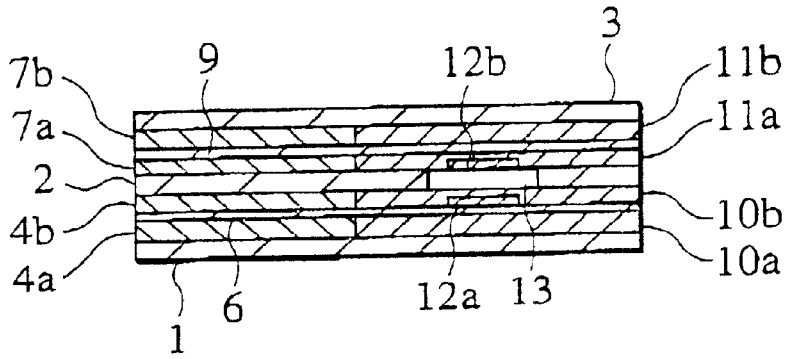
FIGS. 4A, 4B and 4C are a sectional view of an embodiment of the present invention, a plan view of major part of the embodiment of the present invention, and a plan view of another major part of the embodiment of the present invention.
Figure 4B:
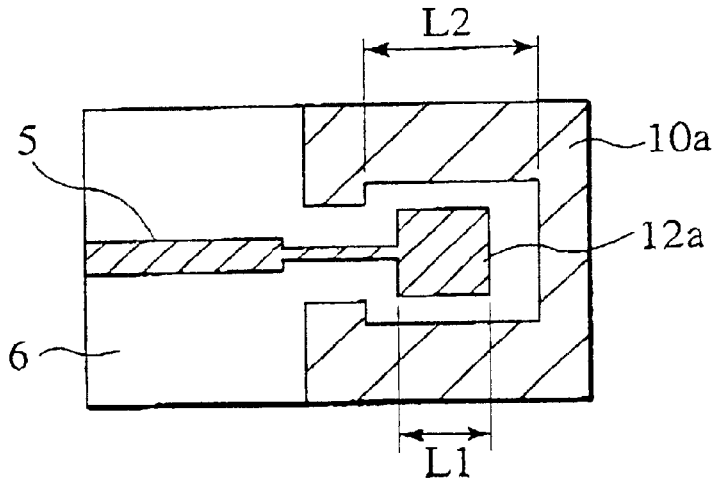
Figure 4C:
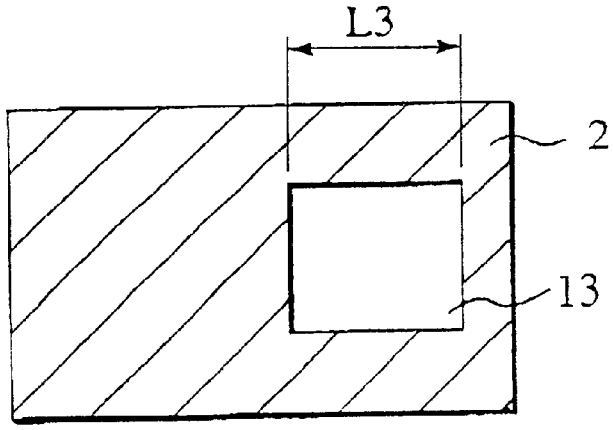

Generally, the shapes of the first patch pattern 12*a,* second patch pattern 12*b* and first slot 13 are square as shown in FIGS. 4B and 4C for first patch pattern 12*a* and first slot 13. This shape may be rectangular because the dimension in the width direction affects the resonant frequency little. Further, this shape may be circular as shown in FIGS. 5B, 5C so as to exert the same effect.

Figure 6A:
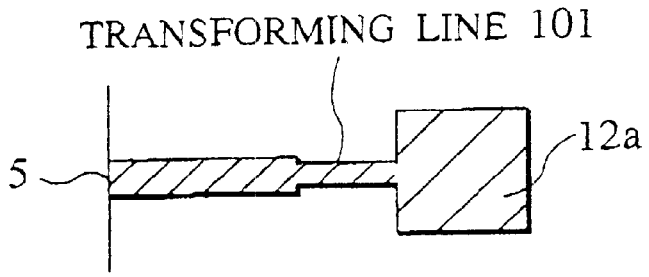
FIGS. 6A, 6B and 6C are plan views showing a connecting state between a patch pattern and a power feeding line for use in the embodiment of the present invention.
Figure 6B:
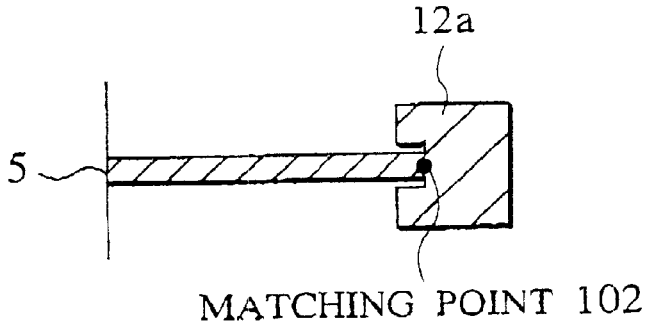
Figure 6C:
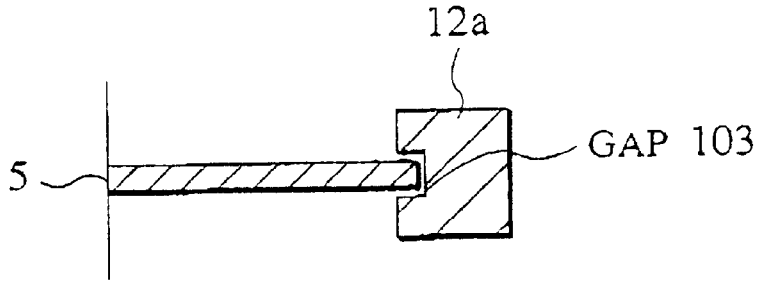

For example, generally, the first patch pattern 12*a* and the first power feeding line 5 are connected through a transforming line 101 substantially ¼ of the line effective wave length of the frequency for use as shown in FIG. 6A in order to match an impedance at an end of the first patch pattern 12*a* with an impedance of the first power feeding line 5. Alternatively, as shown in FIG. 6B, they may be connected directly through a matching point 102 in the patch or as shown in FIG. 6C, capacity coupling through a slight gap 103 is enabled.

Preferable materials and dimensions of respective components are described below.

(First mode)

An aluminum plate 1 mm in thickness is used for the first grounding conductor 1 and the third grounding conductor 3. Expanded polyethylene foam having a thickness of 0.3 mm and a relative dielectric constant of about 1.1 is employed for the first dielectric 4*a,* second dielectric 4*b,* third dielectric 7*a* and fourth dielectric 7*b*. The first power feeding substrate 6 is formed in such a way that unnecessary copper foil is removed from a flexible substrate which is a polyimide film on which the copper foil is bonded by etching to form the first power feeding line 5 and the first patch pattern 12*a*. Similar to the first power feeding substrate 6, the second power feeding substrate 9 is formed in such a way that unnecessary coil foil is removed from the flexible substrate which is a polyimide film on which the copper foil is bonded by etching to form the second grounding conductor 8 and the patch pattern 12*b*. The second grounding conductor 2 is obtained by punching an aluminum plate 0.7 mm in thickness with a mechanical press to make the first slot 13. The first shield spacer 10*a,* second shield spacer 10*b,* third shield spacer 11*a* and fourth shield spacer 11*b* are obtained by punching an aluminum plate 0.7 mm in thickness with a mechanical press.

The first patch pattern 12*a* and the second patch pattern 12*b* were formed in a square shape while L1 shown in FIG. 4B is 1.5 mm which was about 0.38 times the free space wave length ($\lambda_0$=3.95 mm) of a frequency for use of 76 GHz.

The first slot 13 was formed in a square shape while a dimension L3 thereof was 2.3 mm which was about 0.58 times the free space wave length ($\lambda_0$=3.95 mm) of the frequency for use of 76 GHz.

A dimension L2 (FIG. 4B) of each of the first shield spacer 10*a,* second shield spacer 10*b,* third shield spacer 11*a* and fourth shield spacer 11*b* was the same as the dimension L3 (FIG. 4C) of the first slot 13.

Further, a transforming line 101 which was about 0.24 times as long as the free space wave length ($\lambda_0$=3.95 mm) of the frequency for use of 76 GHz was formed at a connecting portion between the first power feeding line 5 and the first patch pattern 12*a,* and the same transforming line 101 was formed at the connecting portion between the second power feeding line 8 and the second patch pattern 12*b*.

Figure 7:
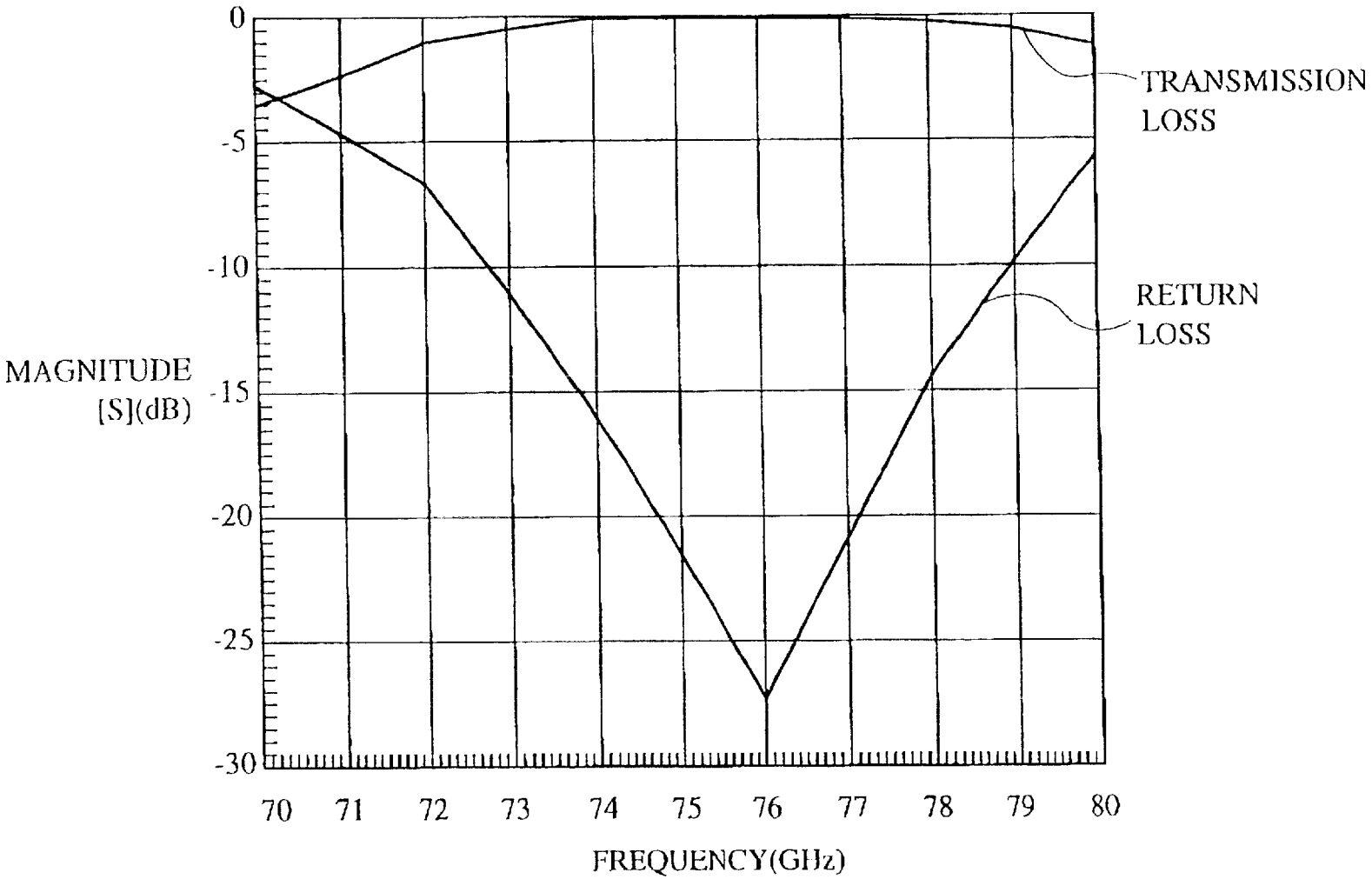
FIG. 7 is a diagram showing frequency characteristics of return loss and transmission loss according to an embodiment of the present invention.

As shown in FIG. 4A, the components described above were overlaid successively so as to compose the triplate line interfacial connector. Then, with a measuring device attached, an electric power was supplied to the first power feeding line 5 and the second power feeding line 8 (not shown in FIG. 4A). A return loss at an end of the first power feeding line 5 and a transmission loss when electricity passed from the first power feeding line 5 to an end face of the second power feeding line 8 were measured. As a result, as shown in FIG. 7, an excellent characteristic was achieved such that the return loss was less than −15 dB and the transmission loss was less than 1 dB in the range of 76±2 GHz.

(Second mode)

Like the first mode, an aluminum plate 1 mm in thickness is used for the first grounding conductor 1 and the third grounding conductor 3. Expanded polyethylene foam having a thickness of 0.3 mm and a relative dielectric constant of about 1.1 is employed for the first dielectric 4*a,* second dielectric 4*b,* third dielectric 7*a* and fourth dielectric 7*b*. The first power feeding substrate 6 is formed in such a way that unnecessary copper foil is removed from a flexible substrate which is a polyimide film on which the copper foil is bonded by etching to form the first power feeding line 5 and the first patch pattern 12*a*. Similar to the first power feeding substrate 6, the second power feeding substrate 9 is formed in such a way that unnecessary coil foil is removed from the flexible substrate which is a polyimide film on which the copper foil is bonded by etching to form the second grounding conductor 8 and the patch pattern 12*b*. The second grounding conductor 2 is obtained by punching an aluminum plate 0.7 mm in thickness with a mechanical press to make the first slot 13. The first shield spacer 10*a,* second shield spacer 10*b,* third shield spacer 11*a* and fourth shield spacer 11*b* are obtained by punching an aluminum plate 0.7 mm in thickness with a mechanical press.

The first patch pattern 12*a* and the second patch pattern 12*b* (not shown in FIG. 5B) were formed in a circular shape while dimension L4 shown in FIG. 5B is 1.5 mm which was about 0.38 times the free space wave length ($\lambda_0$=3.95 mm) of a frequency for use of 76 GHz.

The first slot 13 was formed in a circular shape while a dimension L6 thereof was 2.3 mm which was about 0.58 times the free space wave length ($\lambda_0$=3.95 mm) of the frequency for use of 76 Ghz as shown in FIG. 5C.

A dimension L5 (see FIG. 5B) of each of the first shield spacer 10*a,* second shield spacer 10*b* (not shown in FIG. 5B), third shield spacer 11*a* and fourth shield spacer 11*b* was the same as the dimension L6 of the first slot 13.

Further, a transforming line 101 which was about 0.24 times as long as the free space wave length ($\lambda_0$=3.95 mm) of the frequency for use of 76 GHz was formed at a connecting portion between the first power feeding line 5 and the first patch pattern 12*a,* and the same transforming line 101 was formed at the connecting portion between the second power feeding line 8 and the second patch pattern 12*b*.

Figure 5A:
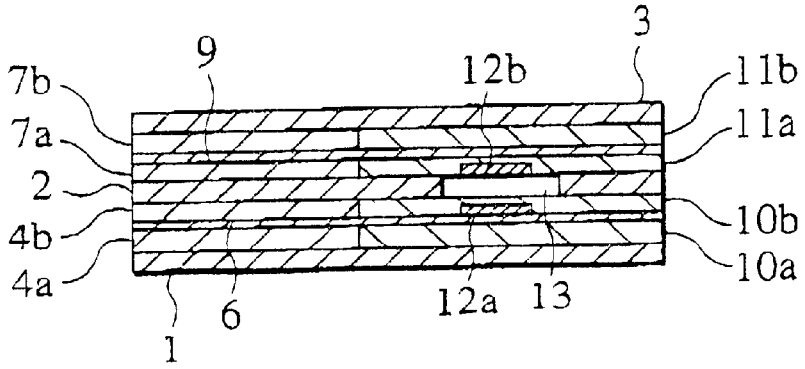
FIGS. 5A, 5B and 5C are a sectional view of another embodiment of the present invention, a plan view of major part of the other embodiment of the present invention, and a plan view of another major part of the other embodiment of the present invention.
Figure 5B:
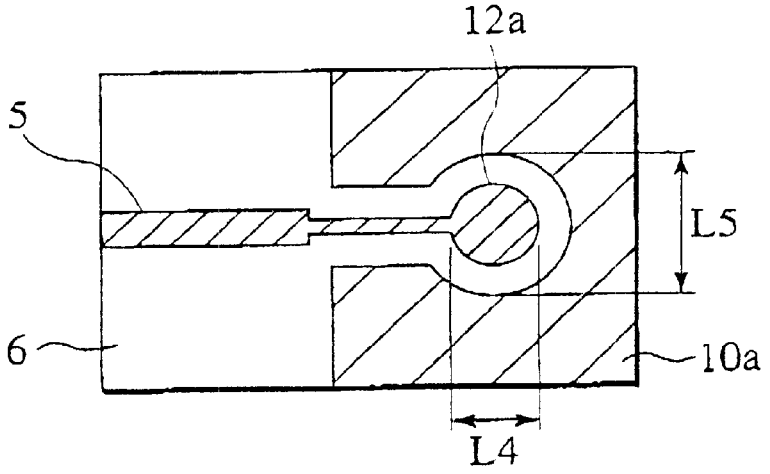
Figure 5C:
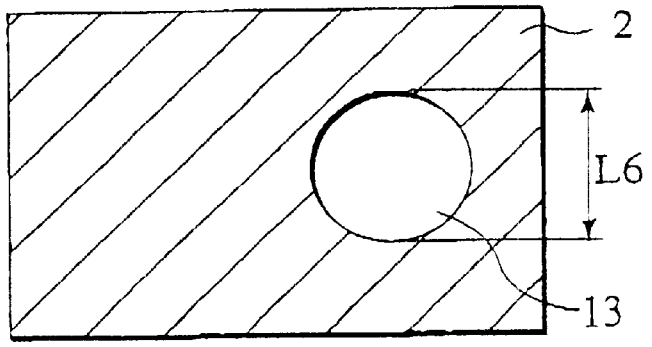

As shown in FIG. 5A, the components described above were overlaid successfully so as to compose the triplate line interfacial connector. Then, with a measuring device attached, an electric power was supplied to the first power feeding line 5 and the second power feeding line 8 (not shown in FIG. 5A). A return loss at an end of the first power feeding line 5 and a transmission loss when electricity passed from the first power feeding line 5 to an end face of the second power feeding line 8 were measured. As a result, an excellent characteristic was achieved like the first mode.

As described above, according to the present invention, it is possible to construct a triplate line interfacial connector ensuring a stabilized frequency characteristic in a wide band with a low loss and further provide a triplate line interfacial connector having few changes of the characteristic due to assembly error and a cheap price.

It should be understood that many modifications and adaptations of the invention will become apparent to those skilled in the art and it is intended to encompass such obvious modifications and changes in the scope of the claims appended hereto.

What is claimed is:

1. A triplate line interfacial connector comprising a first triplate line and a second triplate line, and first triplate line disposed on a first power feeding substrate between a first grounding conductor and a second grounding connector, said second triplate line disposed on a second power feeding substrate between the second grounding conductor and a third grounding conductor, the first power feeding substrate being sandwiched by a first dielectric and a second dielectric, a first power feeding line being formed on the first power feeding substrate, the second power feeding substrate being sandwiched by a third dielectric and a fourth dielectric, a second power feeding line being formed on the second power feeding substrate, wherein a first patch pattern and a second patch pattern are disposed at a connecting terminal portion of the first power feeding line of the first power feeding substrate and a connecting terminal portion of the second power feeding line of the second power feeding substrate, respectively, the first and second dielectrics are absent from around the first patch pattern while a first shield spacer and a second shield spacer each having a through portion relatively larger than the size of the first patch pattern and the first power feeding line connected thereto are provided at the portions in which the first and second dielectrics are absent, the third and fourth dielectrics are absent from around the second patch pattern while a third shield spacer and a fourth shield spacer each having a through portion relatively larger than the size of the second patch pattern and the second power feeding line connected thereto are provided at the portions in which the third and fourth dielectrics are absent, and a first slot is disposed at a portion of the second grounding conductor, the portion corresponding to the first patch pattern and the second patch pattern.

2. A triplate line interfacial connector according to claim 1 wherein a respective length of each of the first patch pattern and the second patch pattern in a corresponding longitudinal direction of each of the first triplate line and the second triplate line is substantially 0.38 times a free space wave length of a frequency for use, a respective dimension of the through portion of each of the first shield spacer, second shield spacer, third shield spacer, and fourth shield spacer in the corresponding longitudinal direction of each of the first triplate line and the second triplate line is substantially 0.6 times the free space wave length of the frequency for use, and a respective dimension of the first slot in the corresponding longitudinal direction of each of the first triplate line and the second triplate line is substantially 0.6 times the free space wave length of the frequency for use.

3. A triplate line interfacial connector according to claim 1 wherein the respective shape of each of the first patch pattern and the second patch pattern is circular, a respective diameter thereof is substantially 0.38 times the free space wave length of the frequency for use, the respective shape of the corresponding through portion around the corresponding patch in each of the first shield spacer, second shield spacer, third shield spacer and fourth shield spacer is circular, a respective diameter of the respective through portion around the corresponding patch is substantially 0.6 times the free space wave length of the frequency for use, and the shape of the first slot is circular while the diameter thereof is substantially 0.6 times the free space wave length of the frequency for use.

* * * * *

UNITED STATES PATENT AND TRADEMARK OFFICE

CERTIFICATE OF CORRECTION

PATENT NO. : 6,545,572 B1
DATED : April 8, 2003
INVENTOR(S) : M. Ohta et al.

It is certified that error appears in the above-identified patent and that said Letters Patent is hereby corrected as shown below:

Column 7,
Line 12, "and" (second occurrence) should be -- said --.

Signed and Sealed this

Sixth Day of January, 2004

JAMES E. ROGAN
*Director of the United States Patent and Trademark Office*